US006098532A

United States Patent [19]

Sebastian et al.

[11] Patent Number: 6,098,532

[45] Date of Patent: Aug. 8, 2000

[54] CONTINUOUS PRESS AND METHOD OF OPERATING SAME

[75] Inventors: Lothar Sebastian, Bochum; Klaus Schürmann, Jüchen; Horst Weiss, Krefeld, all of Germany; Werner Gawlitta, Tegelen, Netherlands

[73] Assignee: G. Siempelkamp GmbH & Co., Krefeld, Germany

[21] Appl. No.: 09/152,941

[22] Filed: Sep. 14, 1998

[30] Foreign Application Priority Data

| | | | |
|---|---|---|---|
| Sep. 13, 1997 | [DE] | Germany | 197 40 325 |
| Jul. 3, 1998 | [DE] | Germany | 198 29 741 |
| Jul. 3, 1998 | [DE] | Germany | 198 29 742 |

[51] Int. Cl.[7] ..... B30B 5/06; B30B 15/34

[52] U.S. Cl. ..... 100/41; 100/43; 100/154; 100/311; 156/583.5; 425/371

[58] Field of Search ..... 100/35, 41, 43, 100/151, 152, 154, 311; 156/555, 583.5; 425/371

[56] References Cited

U.S. PATENT DOCUMENTS

| | | | |
|---|---|---|---|
| 5,112,209 | 5/1992 | Ahrweiler et al. | 100/154 |
| 5,337,655 | 8/1994 | Bielfeldt | 100/154 |
| 5,404,810 | 4/1995 | Bielfeldt | 100/154 |
| 5,546,857 | 8/1996 | Gerhardt et al. | 100/154 |

FOREIGN PATENT DOCUMENTS

| | | |
|---|---|---|
| 44 33 641 | 11/1995 | Germany . |
| 195 18 879 | 12/1996 | Germany . |
| 197 40 325 | 5/1998 | Germany . |

*Primary Examiner*—Stephen F. Gerrity
*Attorney, Agent, or Firm*—Herbert Dubno; Andrew Wilford

[57] ABSTRACT

A continuous press for pressing a thick mat into a thin panel has a press frame, upper and lower press belts having confronting lower and upper stretches defining a press gap extending in a horizontal transport direction, upper and lower flexible intake plates juxtaposed respectively above and below upstream ends of the lower and upper stretches of the belts and defining therewith an intake mouth flaring upstream, and a plurality of hydraulic actuators braced between at least one of the intake plates and the frame and operable to deform the one intake plate and thereby change the spacing of the belts at the mouth. A desired shape of the one intake plate at the mouth is established in accordance with the thickness of the mat, the density of the mat, and the thickness of the panel. Then an actual shape of the one intake plate is detected by the use of an array of position sensors, the detected actual shape of the one intake plate is compared to the desired shape, any variation between the actual shape and the desired shape is determined, and the actuators are pressurized to impart the desired shape to the one intake plate.

20 Claims, 5 Drawing Sheets

CONTINUOUS PRESS AND METHOD OF OPERATING SAME

FIELD OF THE INVENTION

The present invention relates to the manufacture of clipboard, flake board, fiber board, and the like. More particularly this invention concerns a continuous press and a pressing method for producing such boards.

BACKGROUND OF THE INVENTION

In the production of clipboard, flake board, fiber board, and the like it is standard to compress a relatively thick mat by a factor of eight or more into a hard panel. The mat is soft and comprised of wood particles mixed with a phenolic or other binder. The finished workpiece is a hard board or panel with a pair of planar faces.

Such a panel is produced in a continuous press having a rigid press frame having vertically spaced upper and lower parts defining a press gap that can extend some 30 m. Upper and lower belts are spanned in the respective press parts between respective upstream and downstream rollers, at least one of which is driven to advance confronting upper and lower stretches of the lower and upper belts longitudinally through the press. Upper and lower press plates bear, typically by some sort of roller arrangement, on the lower and upper surfaces of the upper and lower stretches of the lower and upper belts. Normally arrays of rollers run between each belt and the respective supporting plate to reduce friction.

The two belts typically are braced at an intake mouth of the gap against flexible intake members or plates. The mouth flares upstream, from a width of more than 100 mm that is wide enough to easily receive the incoming mat down to a dimension somewhat greater than the finished width of the panel, between 10 mm and 20 mm. These intake members are flexible and are typically braced against the press frame by hydraulic cylinders that are hooked to a common controller so that the shape of the intake mouth can be set centrally. Such systems are described in German patent documents 195 18 879 and 197 40 325 as well as in U.S. Pat. No. 5,546,857.

The problem with these systems is that the shape of the intake mouth is generally fixed. It does not take into account conditions that might change during several hours of pressing, for instance a particularly hard or soft spot in the incoming mat. Thus it is possible for the belts to be damaged at the intake mouth. Similarly, resetting the shape of the intake mouth is a hit-or-miss proposition, normally dependent on the experience of the operator of the machine.

OBJECTS OF THE INVENTION

It is therefore an object of the present invention to provide an improved continuous press.

Another object is the provision of such an improved continuous press which overcomes the above-given disadvantages, that is which is not subject to damage if workpiece conditions change.

A further object is to provide an improved method of operating a continuous press of the above-described type.

SUMMARY OF THE INVENTION

A continuous press for pressing a thick mat into a thin panel has a press frame, upper and lower press belts having confronting lower and upper stretches defining a press gap extending in a horizontal transport direction, upper and lower flexible intake plates juxtaposed respectively above and below upstream ends of the lower and upper stretches of the belts and defining therewith an intake mouth flaring upstream, and a plurality of hydraulic actuators braced between at least one of the intake plates and the frame and operable to deform the one plate and thereby change the spacings of the belts at the mouth. According to the invention a desired shape of the one plate at the mouth is established in accordance with the thickness of the mat, the density of the mat, and the thickness of the panel. Then an actual shape of the one plate is detected by means of an array of position sensors, the detected actual shape of the one plate is compared to the desired shape, any variation between the actual shape and the desired shape is determined, and the actuators are pressurized to impart the desired shape to the one plate.

According to the invention pressure with which the mat bears on the one plate is also detected at a plurality of locations on the one plate at the mouth and the actuators are pressurized in accordance with detected pressures.

Thus for each sensor and actuator, since they are paired, there is a respective monitored portion of the one belt. So long as the pressure exerted by the mat is not excessive at this monitored section, feedback-type control is employed to hold the belt to the desired shape. When pressure exceeds a safe level, however, the respective actuator is depressurized to back it off and prevent damage to the belt. If the actual shape varies from the desired shape, this can be corrected by means of the controller and actuators, so long as local pressure limits are of course not exceeded.

The desired curved shape is normally determined outside the press in a laboratory, that is by a simulation. In addition the steps of detection of the actual shape, comparison of the actual shape to the desired shape, and imparting of the desired shape are carried out continuously. The actuators are only pressurized to impart the desired shape to the one plate when the actual shape and the resultant pressure in the mat have been checked. Furthermore a counter pressure of the mat against the belts is simulated outside the press. This counter pressure exerted by the mat against the belts in the mouth is calculated as a starting parameter. The actual shape is continuously monitored and is checked with regard to acceptability and stability.

When pressure with which the mat bears on the one plate is detected at a plurality of locations on the one plate at the mouth, the actuators are depressurized or backed off when the detected pressure exceeds a predetermined pressure threshold. This protects the belts from harm. In fact such pressure detection or monitoring can be done over the entire surface of the one belt to protect the equipment.

The press according to the invention can have heated plates and can use rollers between the plates and the belts. In addition a computer control means separate from the hydraulic controller can be employed to establish a threshold for deformation of the one intake plate dependent on the mat thickness, mat material, and panel thickness. Similarly the computer control means establishes in dependence on a shape of the mouth threshold values for the mat. It is also possible for the computer control means to establish in dependence on a shape of the mouth threshold values for displacement of the mat.

With the system according to the invention it is therefore possible to take into not only the composition of the mat, even including its moisture content, and its size, but also the speed it is moved at to continuously press it into a rigid panel in a hot continuous press. The press is operated in such a manner that local overloading or stressing that could damage the belts is largely eliminated or ruled out.

In accordance with the invention a starting shape for the intake mouth is established. This starting position can be checked by computer, typically by checking the pressure at various locations as a mat is being pressed. Finite-element calculations can be used to determine the pressures needed. In this regard the intake mouth with the intake plates can be subdivided into a so-called finite-element beam with two degrees of freedom, translation and rotation.

In accordance with this invention for each press plate or intake plate standard settings are held in a data base. When a variation of the plate position or shape is desired, an operator can effect it. Before the actual position or shape change is carried out, however, the control system checks that such is permissible. Such checking takes into account not only the capabilities of the press structure, but also the type of workpiece to be pressed and the counter pressures that might be encountered. The interaction of the press and the workpiece create loads that are different for different workpieces, depending on whether one is making flake board, oriented strand board, fiber board, or some kind of partial laminate so that the controller must also take the workpiece into account. Even the size and speed of the workpiece is an important factor in calculating what loads might be encountered. Similarly during operation the data coming from the various sensors is continuously monitored and compared with an acceptable range; when the range is exceeded the press is adjusted or even shut down. As a result accidental damage to the press can be largely avoided.

BRIEF DESCRIPTION OP THE DRAWING

The above and other objects, features, and advantages will become more readily apparent from the following description, reference being made to the accompanying drawing in which.

SPECIFIC DESCRIPTION

Figures 1, 1A:
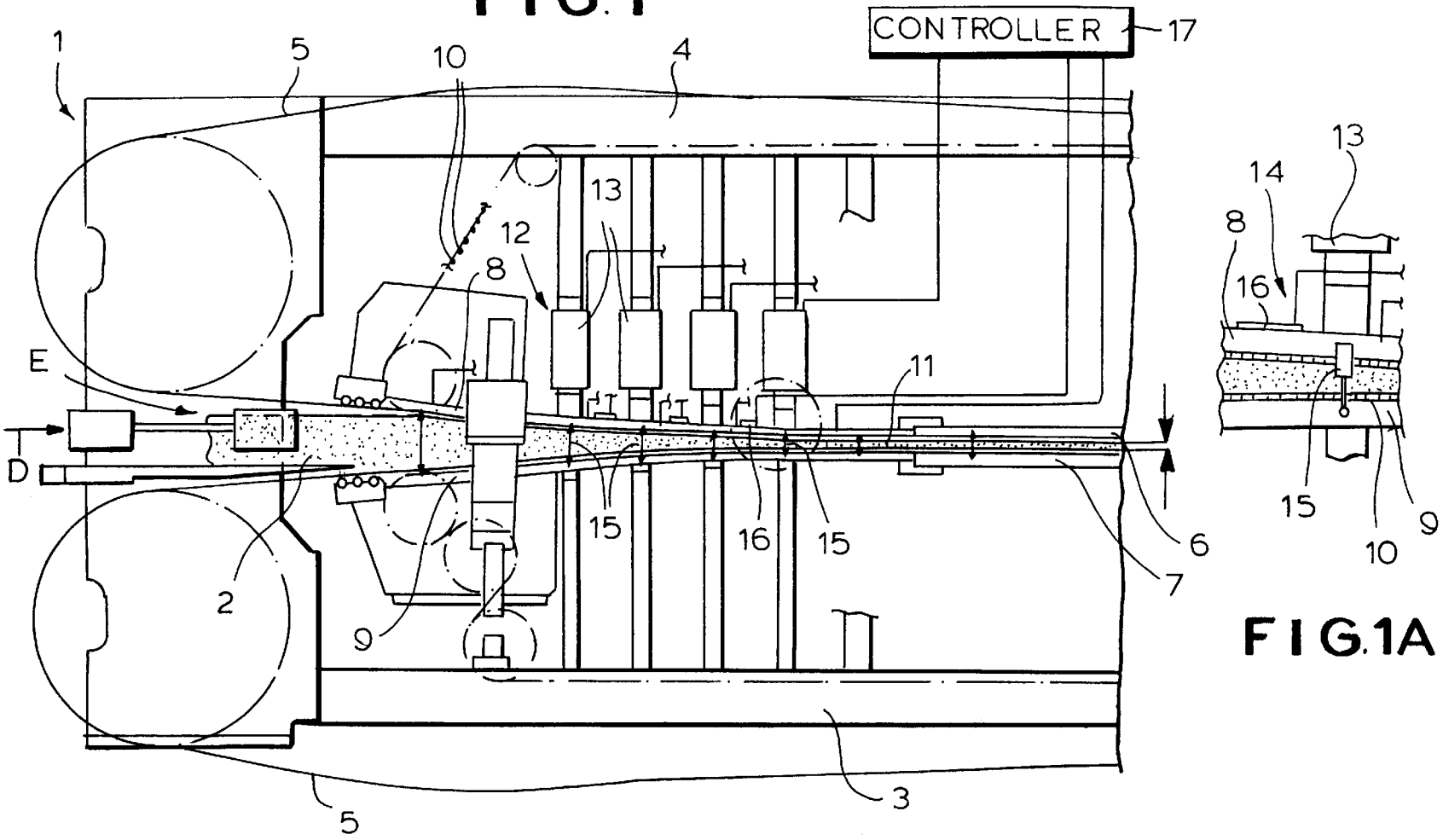
FIG. 1 is a side partly sectional and partly diagrammatic view of a press according to the invention.
FIG. 1A is a large-scale view of the detail indicated at IA in FIG. 1.

As seen in FIGS. 1 and 1A a press 1 according to the invention serves to compress a mat 2 of particles and binder. It has a frame formed by a lower part 3 and an upper part 4. A pair of endless stainless-steel belts 5 have confronting lower and upper stretches riding over heated press platens 6 and 7 and flexible intake plates 8 and 9 to define a pressing gap 11 extending in a horizontal mat transport direction D and having an intake mouth E that opens upstream in the direction D. Respective arrays of rollers 10 ride between the belts 5 and the plates 6–9 to allow them to move smoothly with little friction. The gap 11 starts at the intake mouth E where it is relatively wide to accommodate the mat 2 which is about 100 mm thick to start with and ends at a spacing S equal to the thickness of the finished panel, typically around 16 mm.

According to the invention the press 1 has a system 12 for setting the shape of the belts 5 and plates 8 and 9 at the intake mouth E and along the gap 11. This system 12 comprises a plurality of actuators constituted as hydraulic differential or double-acting cylinders 13 braced between the press part 3 and/or 4 and the plates 8 and/or 9. A common controller 17 is connected to the array of actuators 13 to control them individually.

A system 14 of position sensors 15 and pressure sensors 16, normally strain gauges, is provided to both monitor the positions of the belts 5 along the intake mouth E as well as the pressure with which these belts 5 bear on the mat 2. These sensors 15 and 16 are also connected to the controller 17 so that it is fed actual-value inputs showing the exact shape of the intake mouth E and the pressure with which it is compressing the mat 2. The sensors 15 can also work optically as light curtains or even as camera-like range finders.

In an unillustrated system an external sensor system is provided to determine the deformation of the mat 2 and thus the shape of the intake mouth E. This shape is actually more appropriately calculated in the controller 17 based on certain parameters such as the density of the mat, what it is made of, what if any prepressing it has been subject to, and the like.

Figure 2:
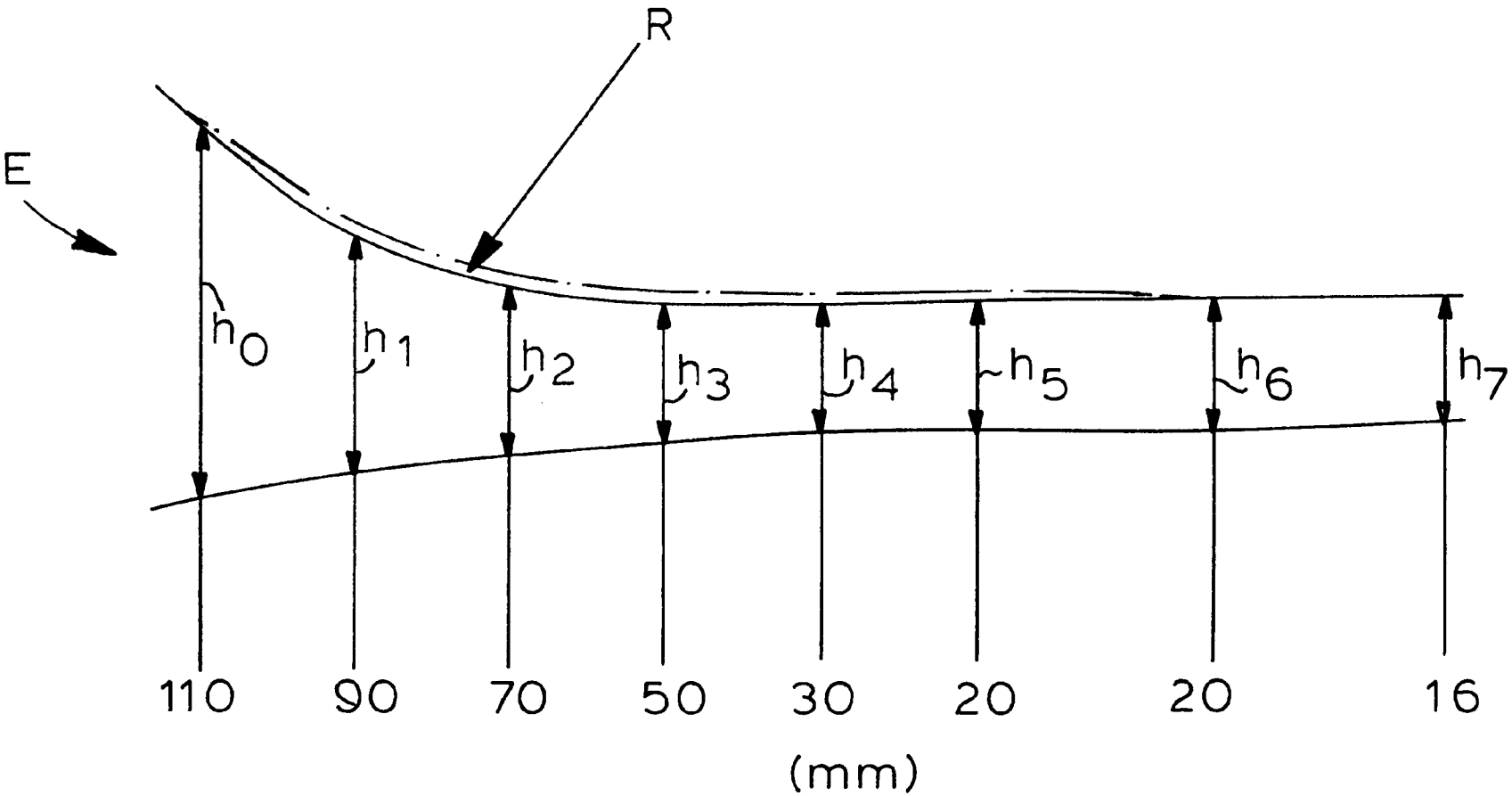
FIG. 2 is a diagrammatic view illustrating the intake mouth of the press.

The shape of the intake mouth E and the pressures the mat 2 is subjected to are illustrated in FIG. 2 The intake mouth E starts at a width or height $h_0$. of 110 mm and decreases through heights $h_1$, $h_2$, $h_3$, $h_4$, $h_5$, and $h_6$ to a height $h_7$ of 16 mm. To this end at least one of the belts 5 follows a path generally corresponding to a circular arc having a radius R of 33 m. This is based on a mat density of 10 kg/$M^3$ and an initial mat thickness of 100 mm.

During a continuous pressing operation the shape of the intake mouth E and the pressure being exerted by the workpiece 2 on the bands 5 are continuously monitored by the sensor system 14. As long as the actual values lie within a predetermined range, that not so high as to damage the belts, or is sensible, that is meets the requirements of the workpiece, the pressing operation is continued and the actuators 13 are maintained under pressure by the controller 17. If the shape changes, the controller 17 effects the necessary adjustment.

Figure 3:
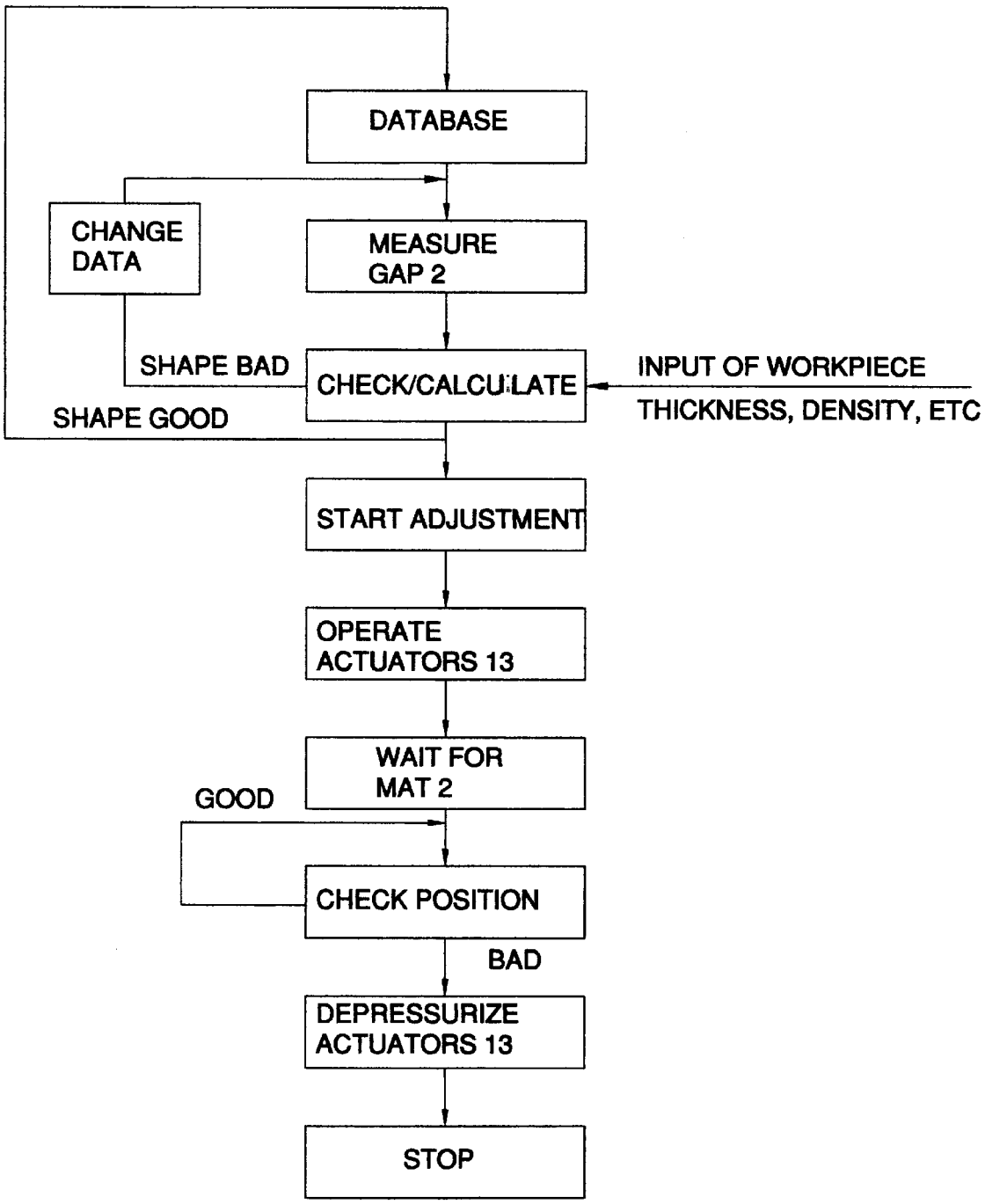
FIG. 3 is a block diagram showing operation of the system of this invention.

FIG. 3 shows by means of an algorithm the main steps of the inventive method. An initial database calculates the shape of the intake mouth E based on the composition and formation of the mat 2 and in the simplest case determines a radius R for at least one of the belts 5 at the mouth E, thereby establishing set points for the system. Then the actual position of the gap 11 is measured by the sensors 15 and compared as actual values $h_0$–$h_7$ with the set points. These actual values are also compared by the controller 17 with the desire panel thickness and other parameters and if necessary the actuators 13 are operated to make the necessary corrections. In the case that the actual values are within the range of acceptable values the mat 2 is fed through the press. During the pressing operation the position of the mat is continuously monitored and as long as the actual values are within acceptable ranges, the actuators 13 are pressurized.

Figures 4, 4A:
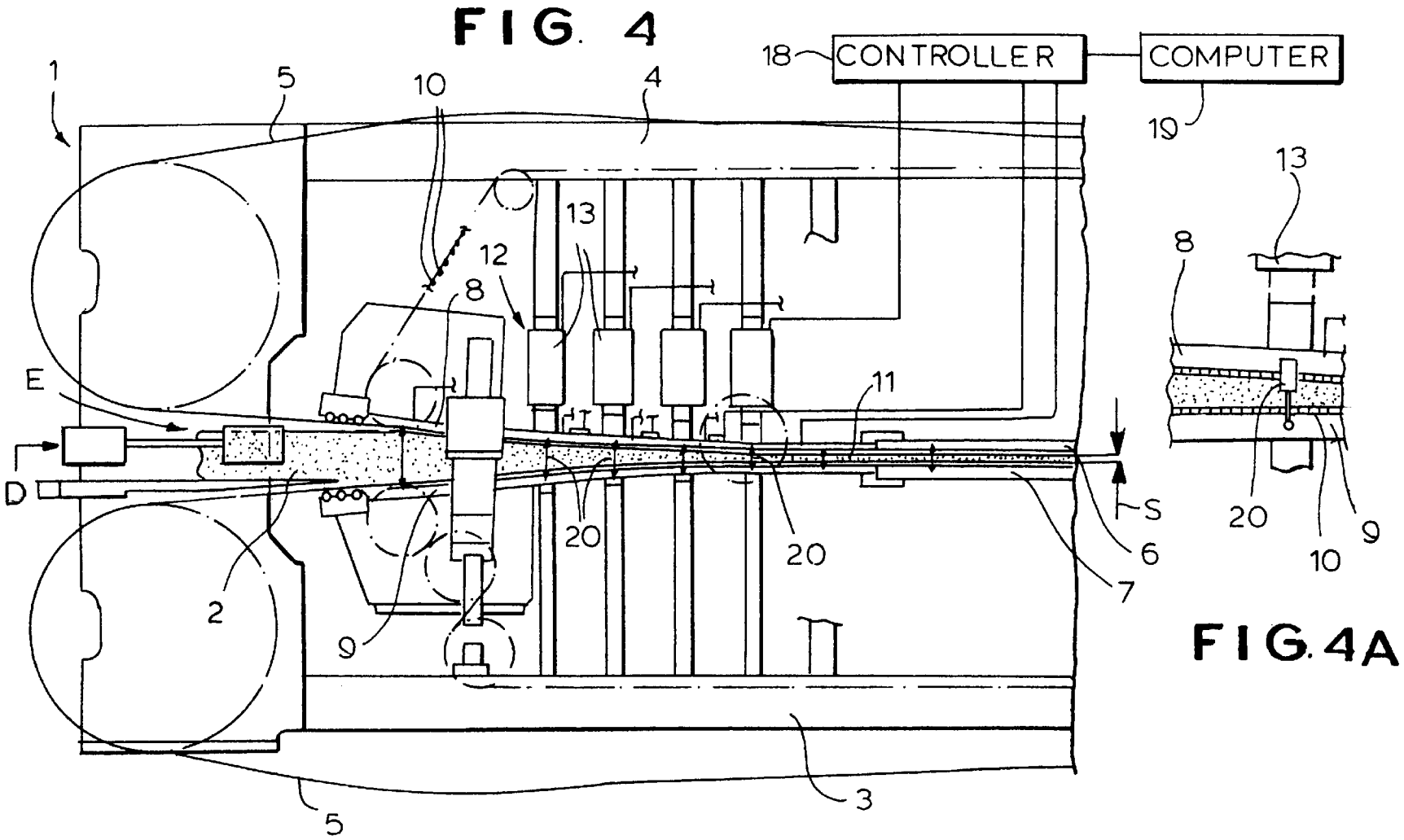
FIG. 4 is a view like FIG. 1 of another press according to the invention.
FIG. 4A is a large-scale view of the detail indicated at IVA in FIG. 4.
Figure 5:
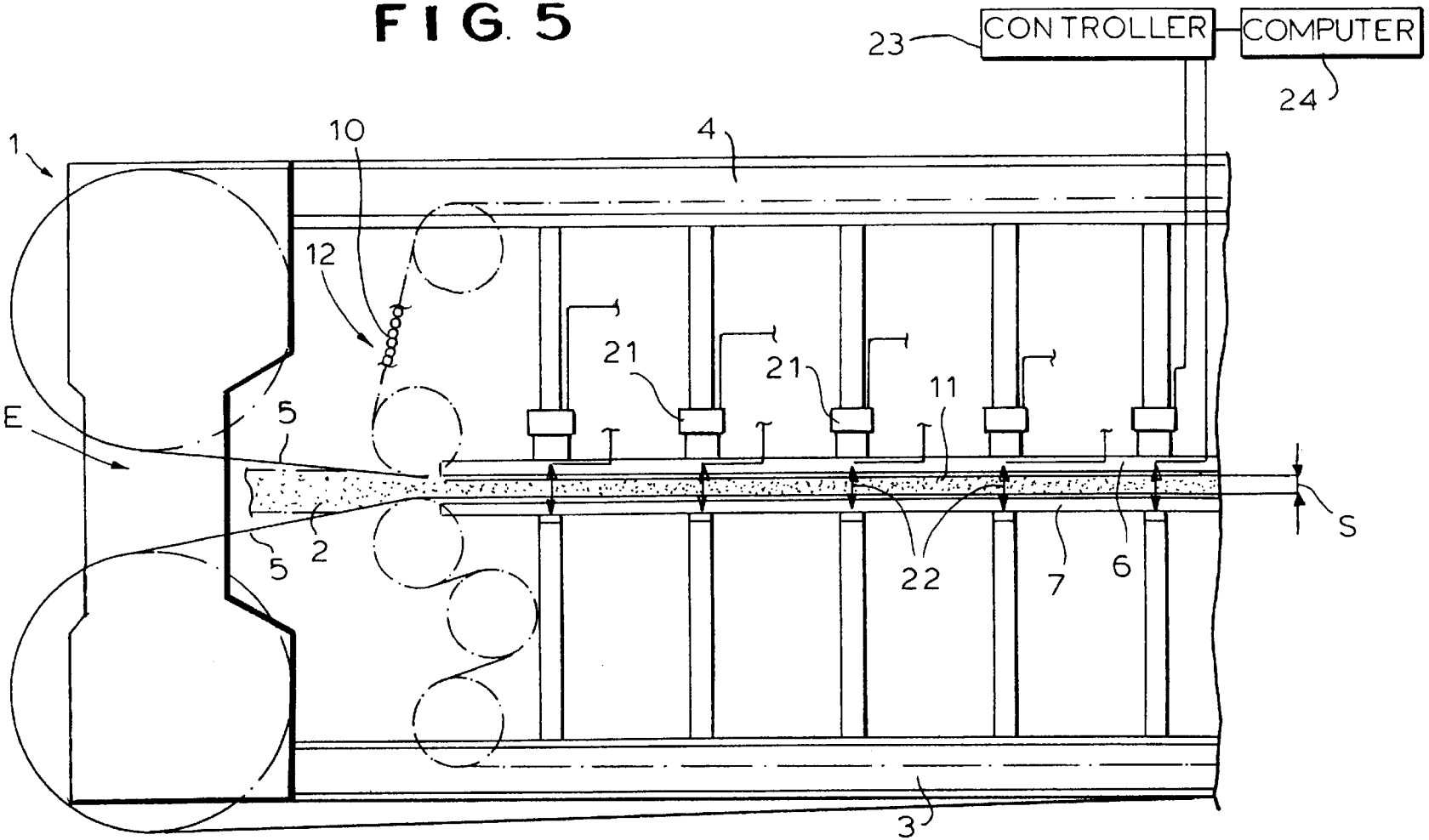
FIG. 5 is a view like FIGS. 1 and 4 of yet another press in accordance with the invention.

In the systems of FIGS. 4 and 5 the differential actuators 13 are connected to a controller 18 with a calculator or computer 19. In addition a plurality of position sensors 20 are provided on the upper and lower press plates 8 and 9.

The computer 19 serves to monitor the outputs of the sensors 20 and of the sensors measuring pressure so as to prevent overloading of the plates 8 and 9. Only when within acceptable parameters is the press 1 allowed to operate.

The position sensors 16 always permit the computer-supported determination and setting of the shape of the intake mouth E and thus are connected to the controller 18. This is also true in this embodiment for the cylinders 13 which are part of the hydraulic system. While the controller 18 establishes the shape of the intake mouth E, the actual position of same is monitored by the computer 19. If the loading of the plates 8 or 9 is determined to lie outside the acceptable range, the cylinders 13 are depressurized.

In order to adjust the shape of the belts 5 in the gap 11 downstream of the mouth E there are a plurality of hydraulic actuators 21 associated with respective position detectors 22 as shown in FIG. 5, all connected to a controller 23 and computer 24. The computer 24 is connected to the sensors 22 and serves to regulate the spacing S of the gap 11 downstream of the mouth E. Of course the computer 24 can be part of the controller 23.

We claim:

1. A method of operating a continuous press to press a thick mat into a thin panel, the press having a press frame;

upper and lower press belts having confronting lower and upper stretches defining a press gap extending in a horizontal transport direction;

upper and lower flexible intake plates juxtaposed respectively above and below upstream ends of the lower and upper stretches of the belts and defining therewith an intake mouth flaring upstream; and a plurality of hydraulic actuators braced between at least one of the intake plates and the frame and operable to deform the one intake plate and thereby change the spacing of the belts at the mouth, the method comprising the steps of:

establishing in accordance with the thickness of the mat, the density of the mat, and the thickness of the panel a desired curved shape for at least the one intake plate;

detecting an actual shape of the one intake plate by means of an array of position sensors;

comparing the actual shape of the one intake plate and determining any variation between the actual shape and the desired shape, and pressurizing the actuators to impart the desired shape to the one intake plate.

2. The press-operating method defined in claim 1, further comprising the steps of detecting pressure with which the mat bears on the one intake plate at a plurality of locations on the one intake plate at the mouth; and pressurizing in accordance with detected pressures.

3. The press-operating method defined in claim 1 wherein the desired curved shape is determined in a laboratory.

4. The press-operating method defined in claim 1 wherein the steps of detection of the actual shape, comparison of the actual shape to the desired shape, and imparting of the desired shape are carried out continuously.

5. The press-operating method defined in claim 1 wherein the actuators are only pressurized to impart the desired shape to the one intake plate when the actual shape and the resultant pressure in the mat have been checked.

6. The press-operating method defined in claim 1 wherein a counter pressure of the mat against the belts is simulated outside the press.

7. The press-operating method defined in claim 1 wherein a counter pressure exerted by the mat against the belts in the mouth is calculated as a starting parameter.

8. The press-operating method defined in claim 1 wherein the actual shape is continuously monitored and is checked with regard to acceptability and stability.

9. The press-operating method defined in claim 1, further comprising the steps of:

detecting pressure with which the mat bears on the one intake plate at a plurality of locations on the one intake plate at the mouth; and depressurizing the actuators when the detected pressure exceeds a predetermined pressure threshold.

10. The press-operating method defined in claim 9 wherein pressure is monitored over the entire surface of one of the belts.

11. A press for pressing a thick mat into a thin panel, the press comprising:

a press frame;

upper and lower press belts having confronting lower and upper stretches defining a press gap extending in a horizontal transport direction;

upper and lower flexible intake plates juxtaposed respectively above and below upstream ends of the lower and upper stretches of the belts and defining therewith an intake mouth flaring upstream;

a plurality of hydraulic actuators braced between at least one of the intake plates and the frame and operable to deform the one intake plate and thereby change the spacing of the belts at the mouth;

means including an array of position sensors for detecting an actual shape of the one intake plate;

control means for establishing in accordance with the thickness of the mat, the density of the mat, and the thickness of the panel a desired curved shape for at least the one intake plate, for comparing the actual shape of the one intake plate and determining any variation between the actual shape and the desired shape, and for pressurizing the actuators to impart the desired shape to the one intake plate.

12. The press defined in claim 11, further comprising means including an array of pressure sensors distributed over the belt at the one intake plate for detecting pressure exerted by the mat against the one intake plate at the belt.

13. The press defined in claim 12 wherein the pressure sensors are strain gauges.

14. The press defined in claim 13 wherein the position sensors function optically.

15. The press defined in claim 11 wherein the control means includes means for externally measuring mat deformation for determining mat deformation effected by the mouth.

16. A press for pressing a thick mat into a thin panel, the press comprising:

a press frame;

upper and lower press plates on the frame;

upper and lower press belts having confronting lower and upper stretches defining a press gap extending in a horizontal transport direction and respectively running below and above the upper and lower press plates;

respective arrays of rollers between each press plate and the respective stretch;

upper and lower flexible intake plates juxtaposed respectively above and below upstream ends of the lower and upper stretches of the belts and defining therewith an intake mouth flaring upstream;

a plurality of differential hydraulic actuators braced between at least one of the intake plates and the frame and operable to deform the one intake plate and thereby change the spacing of the belts at the mouth;

means including an array of position sensors for detecting an actual shape of the one intake plate;

hydraulic control means connected to the actuators for pressurizing same; and computer control means connected to the hydraulic control means for establishing in accordance with the thickness of the mat, the density of the mat, and the thickness of the panel a desired curved shape for at least the one intake plate, for comparing the actual shape of the one intake plate and determining any variation between the actual shape and the desired shape, and operating the hydraulic control means to pressurize the actuators to impart the desired shape to the one intake plate.

17. A press for pressing a thick mat into a thin panel, the press comprising:

a press frame;

upper and lower heated press plates on the frame;

upper and lower press belts having confronting lower and upper stretches defining a press gap extending in a horizontal transport direction and respectively running below and above the upper and lower press plates;

respective arrays of rollers between each press plate and the respective stretch;

upper and lower flexible and heated intake plates juxtaposed respectively above and below upstream ends of the lower and upper stretches of the belts and defining therewith an intake mouth flaring upstream;

a plurality of differential hydraulic actuators braced between at least one of the intake plates and the frame and operable to deform the one intake plate and thereby change the spacings of the belts at the mouth;

means including an array of position sensors for detecting an actual shape of the one intake plate;

hydraulic control means connected to the actuators for pressurizing same; and computer control means connected to the hydraulic control means for establishing in accordance with the thickness of the mat, the density of the mat, and the thickness of the panel a desired curved shape for at least the one intake plate, for comparing the actual shape of the one intake plate and determining any variation between the actual shape and the desired shape, and operating the hydraulic control means to pressurize the actuators to impart the desired shape to the one intake plate.

18. The press defined in claim 17 wherein the computer control means establishes a threshold for deformation of the one intake plate dependent on the mat thickness, mat material, and panel thickness.

19. The press defined in claim 17 wherein the computer control means establishes in dependence on a shape of the mouth threshold values for the mat.

20. The press defined in claim 17 wherein the computer control means establishes in dependence on a shape of the mouth threshold values for displacement of the mat.

* * * * *